US005573621A

United States Patent [19]

Boreali

[11] Patent Number: 5,573,621

[45] Date of Patent: Nov. 12, 1996

[54] NON-QUADRATE LINERLESS LABEL CONSTRUCTION, METHODS OF USE AND APPLICATION

[75] Inventor: Jeffrey J. Boreali, North Tonawanda, N.Y.

[73] Assignee: Moore Business Forms, Inc., Grand Island, N.Y.

[21] Appl. No.: 351,221

[22] Filed: Nov. 30, 1994

[51] Int. Cl.[6] ..... B65B 1/02

[52] U.S. Cl. ..... 156/256; 156/267; 156/521; 156/556; 225/100

[58] Field of Search ..... 156/556, 542, 156/521, 256; 225/95, 100

[56] References Cited

U.S. PATENT DOCUMENTS

| | | | |
|---|---|---|---|
| 385,158 | 6/1888 | Woodhull . | |
| 2,678,748 | 5/1954 | McCain et al. | 156/521 |
| 2,990,081 | 6/1961 | Neui et al. | 156/521 |
| 3,038,597 | 6/1962 | Brady, Jr. | 206/56 |
| 3,193,430 | 7/1965 | Messmer et al. | 156/355 |
| 3,914,483 | 10/1975 | Stipek, Jr. | 40/638 |
| 4,210,688 | 7/1980 | Sato | 428/41 |
| 4,375,189 | 3/1983 | Berner et al. | 225/100 |
| 4,397,410 | 8/1983 | Schueler | 225/100 |
| 4,454,180 | 6/1984 | La Mers | 428/42 |
| 4,984,683 | 1/1991 | Eller | 206/38 |
| 4,985,096 | 1/1991 | Bekker-Madsen | 156/521 |
| 5,022,526 | 6/1991 | Crum | 206/459 |
| 5,112,427 | 5/1992 | Bekker-Madsen | 156/259 |
| 5,294,283 | 3/1994 | Guardiola | 156/556 |

FOREIGN PATENT DOCUMENTS

| | | |
|---|---|---|
| 0360108 | 3/1990 | European Pat. Off. . |
| 0361184 | 4/1990 | European Pat. Off. . |
| 376754 | 7/1990 | European Pat. Off. . |
| 577241 | 1/1994 | European Pat. Off. . |
| WO95/15905 | 6/1995 | WIPO . |

*Primary Examiner*—Robert A. Dawson
*Assistant Examiner*—Linda L. Gray
*Attorney, Agent, or Firm*—Nixon & Vanderhye P.C.

[57] ABSTRACT

A label assembly includes a string of a plurality of non-quadrate (e.g., circular) linerless labels disposed in-line with at least one tie about 0.018–0.030 inches in width connecting consecutive labels in the string together. Each label has a first face with adhesive release material and a second face with pressure sensitive adhesive. The string may be in roll form and taken off the roll and run through a burster for bursting the ties between the labels. The labels may initially also be tied to a matrix from which the string labels is continuously separated. The burster may include high and low speed rolls with a non-stick surface between them and a bursting blade above the non-stick surface. Downstream of the high speed rolls is a sensor, and a mechanism for applying the separated linerless labels to a surface, such as a reciprocating plunger, air blast nozzles, a vacuum cylinder, or a conveyor belt.

14 Claims, 4 Drawing Sheets

FIG. 5
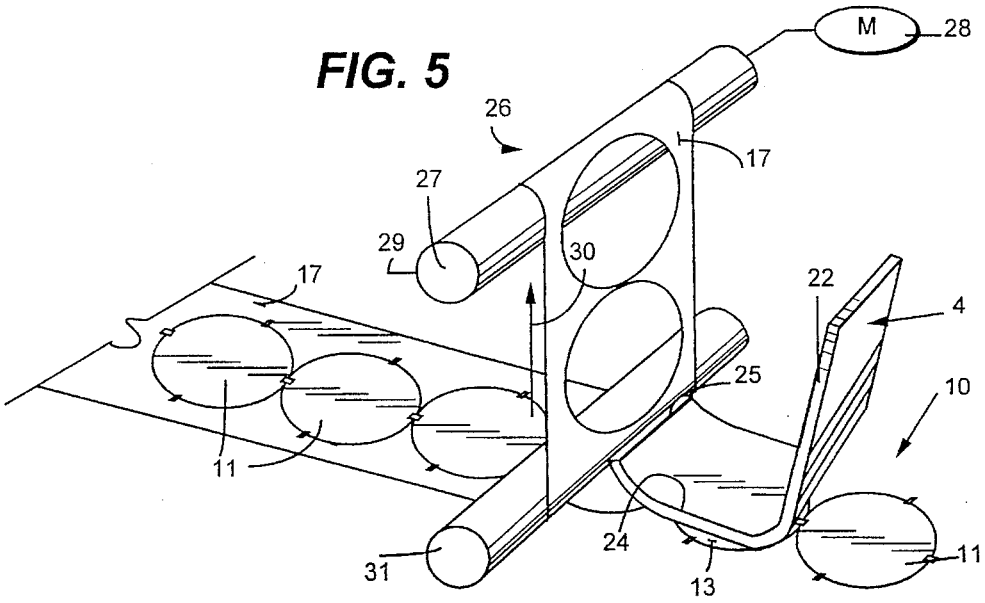
FIG.6
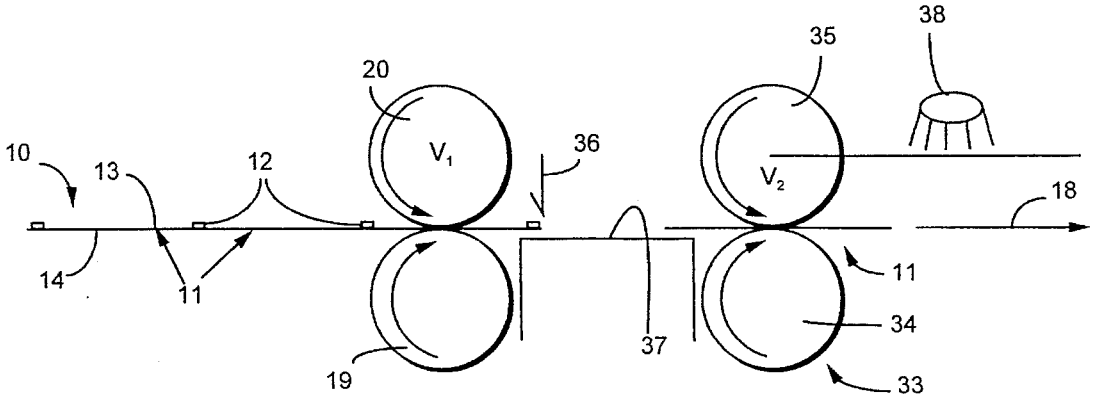
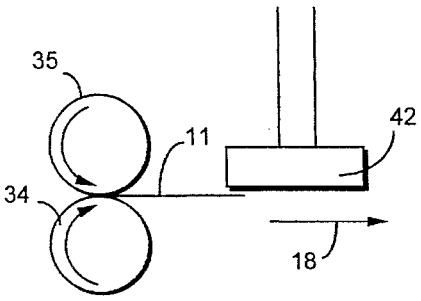
FIG. 7
FIG. 8
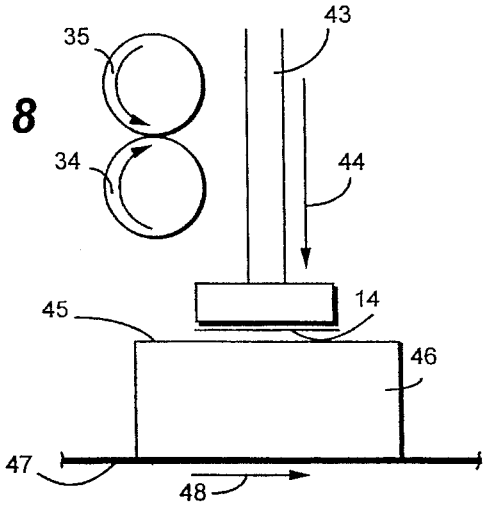

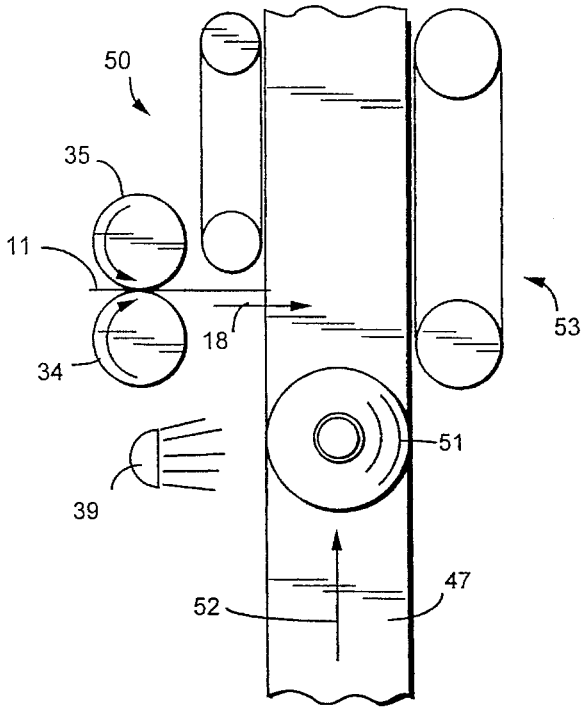
FIG. 9
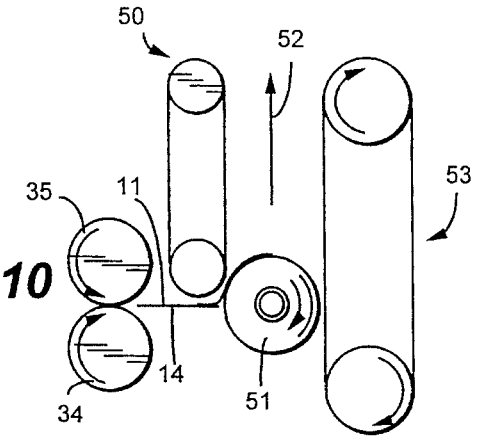
FIG. 10
FIG. 11
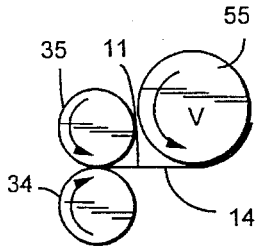
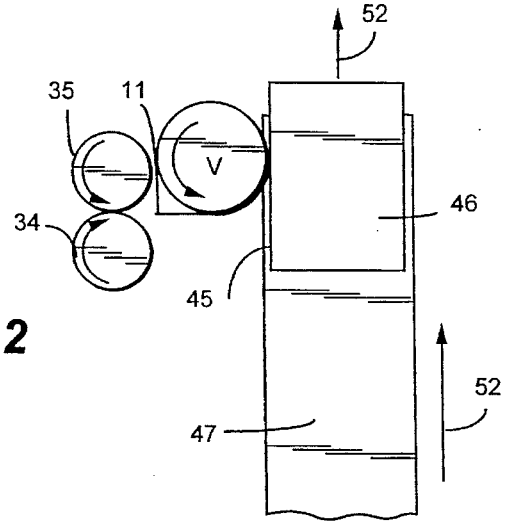
FIG. 12

NON-QUADRATE LINERLESS LABEL CONSTRUCTION, METHODS OF USE AND APPLICATION

BACKGROUND AND SUMMARY OF THE INVENTION

There are many circumstances in which non-quadrate (e.g., circular, oval, triangular, or polygonal shape) labels are utilized, being applied to surfaces. In the last few years there has been an increasing demand for linerless labels because of the environmental and other advantages associated with them. The use of non-quadrate linerless labels, per se, is shown in pending application Ser. No. 08/173,083, filed Dec. 27, 1993. According to the present invention, a particular string of non-quadrate linerless labels is provided, as well as a method of detaching the individual labels from the string, a method of separating the string from surrounding matrix material, a method of applying burst labels directly to the surfaces of moving items, and apparatus for practicing all of these methods.

According to one aspect of the present invention, a method of acting on individual non-quadrate linerless labels in a string of in-line non-quadrate linerless labels connected to the other by ties is provided. The method is practiced using a burster having a first pair of low speed rolls, and a second pair of high speed rolls with a stationary blade between the roller pairs. The method comprises the following steps: (a) Moving the string of non-quadrate linerless labels, in a first direction, to the first pair of rolls. (b) Feeding the labels, one at a time, in sequence from the low speed rolls to the high speed rolls so that a tie connecting two consecutive labels of the string is positioned between the pairs of rolls. (c) Acting on a leading string with the high-speed rolls to cause the string to be tensioned and the tie between the roll pairs to engage the stationary blade and burst. And, (d) discharging the leading label, burst from the string in step (c), from the high speed rolls.

The labels have a first face with adhesive release material and a second face with pressure sensitive adhesive. Step (c) is typically practiced by bringing the non-adhesive face into contact with the stationary blade. There is also preferably the further step of, except during tensioning as recited in step (c), guiding the labels from the first and second roll pairs by bringing the adhesive face into contact with a non-stick guiding surface.

Normally, the string of labels is originally connected to a surrounding matrix by ties, in which case there is the further step, prior to step (a), of (e) separating the leading labels from the matrix; and (f) continuously automatically pulling the matrix in a second direction, distinct from the first direction, while physically engaging the label string so that the labels are not pulled with the matrix but instead are fed to the first rollers as recited in steps (a) and (b) separated from the matrix. Step (f) is typically practiced by physically engaging the first face of the label string with a smooth, substantially stationary surface.

After the practice of step (d), there is a further step of bringing the detached leading linerless label second face into contact with a surface to which the adhesive adheres. This additional step may be practiced by pushing the first face in a third direction, substantially transverse to the first direction, until the second face engages the surface, or by engaging the first face with a rotatable element and rotating the rotatable element to assist in moving the label second face into contact with the surface, by substantially simultaneously moving the surface into engagement with the second face by using air blast nozzles, or the like.

There may also be the further step of sensing the presence of the leading label being discharged during the practice of step (d), and moving the surface toward the label in response to that sensing. The label string is typically pulled by the low speed roll to move into proper position. Also, typically, there is a speed differential of between 3:1 to 2:1 between the high speed and low speed rolls.

The invention also relates to a label assembly per se which consists of: A string of a plurality of non-quadrate linerless labels disposed in line with at least one tie about 0.018–03 inches in width connecting consecutive labels in the string together, each label having a first face with adhesive release material and a second face with pressure sensitive adhesive. The labels may be circular, with a single tie connecting each label to another consecutive label in a string, and the string labels may be in roll form.

The invention also relates to apparatus for bursting individual labels from a string of in-line labels connected by ties. The apparatus comprises the following elements: A pair of low speed rolls with a nip therebetween. A pair of high speed rolls, with a nip therebetween. The rolls mounted so that the nips are in an imaginary straight line, and the rolls are all rotatable about substantially parallel axes of rotation A non-stick surface mounted between the low and high speed rolls extending substantially along the imaginary straight line. And a stationary bursting blade mounted between the pairs of rolls above the non-stick surface. The non-stick surface is preferably a plasma coated surface. Sensors are also typically associated with the apparatus, including a sensor located downstream of the high speed rolls.

The invention also relates to apparatus for separating a string of in-line labels connected by ties from a surrounding matrix to which the labels are also connected by ties. The apparatus comprises the following elements: A conveyor mechanism for pulling the labels in a first direction. A stationary hold-down device for engaging the labels after separation from the matrix and holding the labels so that they do not travel with the matrix. A matrix take-up mechanism for moving the matrix in a second direction distinct from and intersecting the first direction. And, an abutment engaging the matrix and the string of labels where the first and second directions intersect. The abutment preferably comprises a first roller rotatable about an axis substantially perpendicular to the first direction, which may be driven but preferably is an idler roller. The matrix take-up preferably includes a powered second roller rotatable about an axis parallel to the first roller axis. The stationary hold-down device preferably comprises an arm of rigid, smooth material.

According to another aspect of the present invention, linerless label applying apparatus is provided. This apparatus comprises the following elements: A pair of rolls having a nip therebetween, the rolls rotatable about parallel axes, extending in a first dimension, and the rolls pulling a linerless label therebetween in a second direction substantially perpendicular to the first dimension. Label engaging means downstream of the rolls in the second direction for engaging a label as it moves through the nip. And, conveyor means for moving a surface into operative association with the label engaging means so that the label is applied to the surface. The label engaging means may comprise a reciprocating plunger, conveyor belt, vacuum cylinder, at least one gas blast nozzle, or a variety of other structures.

It is a primary object of the present invention to provide for the effective and simple detachment of non-quadrate linerless labels from a string, and the application of the detached labels to a moving surface, in an automatic manner. This and other objects of the invention will become clear from an inspection of the detailed description of the invention and from the appended claims.

BRIEF DESCRIPTION OF THE DRAWINGS

FIG. 5 is a top perspective schematic view of the apparatus of FIG. 4;

FIG. 6 is a side schematic view of an exemplary bursting apparatus for bursting the label string of FIG. 2, according to the present invention;

FIGS. 7 and 8 are side schematic views showing the high speed rolls of the burster of FIG. 6 in conjunction with a reciprocating plunger for applying a detached label to a moving surface;

FIGS. 9 and 10 are views likes those of FIGS. 7 and 8 only showing a belt conveyor system downstream of the high speed roll for applying the label to a bottle or the like;

FIGS. 11 and 12 are views like that of FIGS. 7 and 8 only showing a vacuum cylinder and differently disposed conveyor downstream of the high speed roll.

DETAILED DESCRIPTION OF THE DRAWINGS

Figure 1:
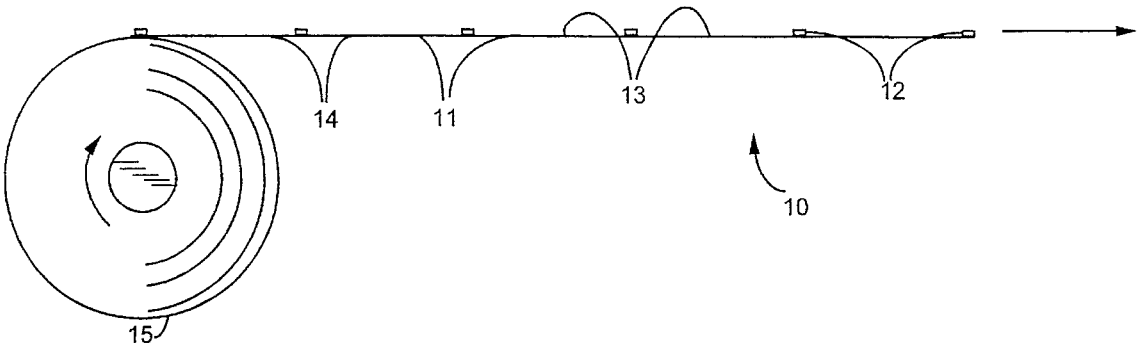
FIG. 1 is a side view of a label assembly string according to the present invention moving from roll to linear form.
Figure 2:
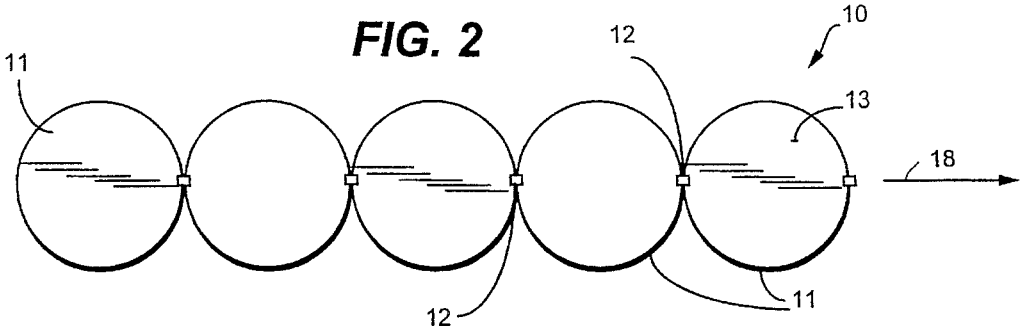
FIG. 2 is a top plan view of the string in FIG. 1.

A label assembly according to the present invention is shown generally by reference numeral 10 in FIGS. 1 and 2. It consists of a string of a plurality of non-quadrate linerless labels 11 disposed in-line with at least one tie about 0.018–0.030 inches in width connecting consecutive labels and the string together. Each label 11 has a first face 13 with adhesive release material, e.g., silicone, thereon and a second face 14 (see FIG. 1) with pressure-sensitive adhesive (which may be repositional, removable or permanent). The assembly 10 may be in roll form, as illustrated by the roll 15 in FIG. 1, and taken off from the roll intermittently, continuously, or in groups (such as the group illustrated in FIG. 2).

The non-quadrate configuration of the labels 11 may be of a wide variety of different types. For example, the labels 11 may be circular as seen in FIGS. 1 and 2, oval, triangular, or of another non-quadrate polygon shape. Where circular labels 11 are utilized, as seen in FIGS. 1 and 2, typically only a single tie 12 is provided between adjacent labels. Where the labels have other shapes, more than one tie may be provided, but the ties typically always have a width of between about 0.018–0.030 inches.

Figure 3:
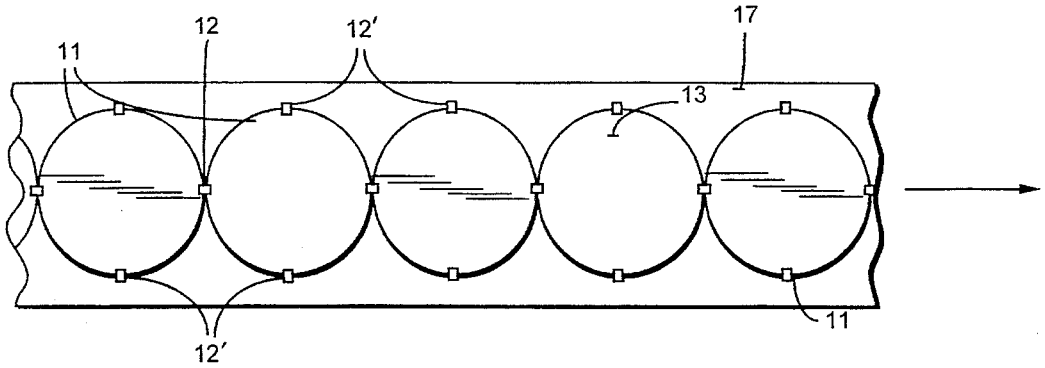
FIG. 3 is a top plan view of a string like that of FIG. 2 before detachment from the surrounding matrix material.

Normally—as described in said copending application Ser. No. 08/173,083—the string of labels is initially within a matrix 17—as seen in FIG. 3. It is also connected to the matrix by ties—such as the ties 12, which also preferably have a width of about 0.018–0.030 inches. The string of labels 10 is separated from the matrix material 17 automatically, preferably utilizing the apparatus such as illustrated in FIGS. 4 and 5.

Figure 4:
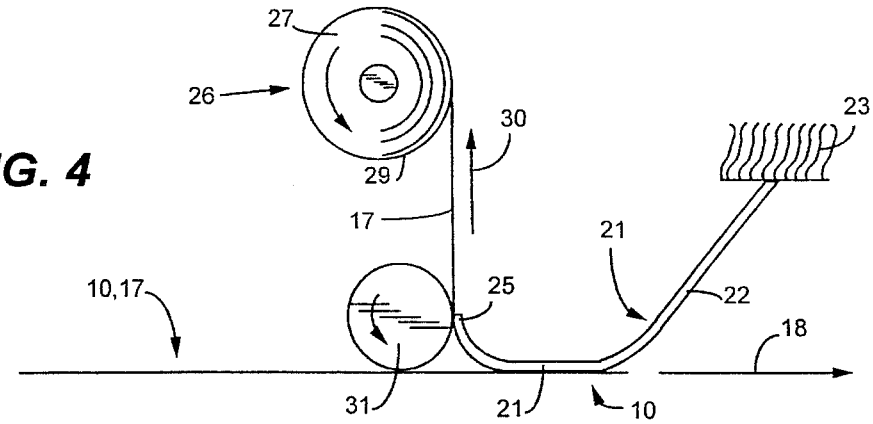
FIG. 4 is a side schematic view of apparatus for separating the label string of FIG. 3 from the matrix material of FIG. 3.

The apparatus of FIGS. 4 and 5 includes a conveying mechanism for conveying the string of labels in a first direction 18 (see FIG. 4), the conveyor mechanism typically comprising the low speed rolls 19, 20 of a detacher (as illustrated in FIG. 6). A conveyor belt, conveyor bottom rollers, conveying slats, conveying chains, toothed wheels, or a wide variety of other mechanisms may also be provided as the conveying means for moving the label string in the direction 18.

The matrix/label string detachment mechanism also preferably comprises a stationary label hold-down mechanism 21, which may—as illustrated in FIGS. 4 and 5—be in the form of an arm having an angled body portion 22 stationarily mounted to a stationary support 23 at a first end thereof, a bottom portion 24 which is substantially parallel to the direction 18, and an up-turned end portion 25 of the element 24. The arm 21 is preferably formed of a piece of Lexan or plastic, and is relatively rigid, although it has some flexibility. It is typically light in weight and preferably at least the portion thereof that engage the adhesive release faces 13 or the label string 10 is smooth so that it does not mark, tear or otherwise adversely affect the labels 11.

The matrix/label detachment mechanism also includes a matrix take-up shown generally by reference numeral 26, and preferably including a take-up roller 27 driven by a motor 28 or the like and about which the matrix material 17 is initially wrapped. The axis of rotation of the roller 27, about which it is driven by the motor 28, is in a second dimension 29 which is preferably perpendicular to the first direction 18. The take-up roller 27 moves the matrix in a second so direction 30, which is distinct from and intersects the first direction 18. In the preferred embodiment illustrated in FIGS. 4 and 5, the second direction 30 is perpendicular to the first direction 18.

Finally, the matrix/label string separation mechanism comprises an abutment, preferably a powered or idler roller 31, engaging the matrix 17 and the string of labels 10 where the first and second directions 18/30 intersect. The roller 31 is rotatable about an axis parallel to the axis 29. When powered the roller 31 may comprise, or may comprise part of, the conveyor mechanism for pulling the labels in the direction 18.

An exemplary burster according to the present invention is shown generally by reference numeral 33. In addition to the low speed rolls 19, 20 the burster 33 includes a pair of high speed rolls 34, 35, each of the sets of rolls 19, 20 and 34, 35 having a nip between them. The rolls 19, 20 and 34, 35 are mounted so that the nips are in an imaginary straight line from one to the other (preferably at the same horizontal or vertical position) and all of the rolls 19, 20, 34, 35 are rotatable about substantially parallel axes of rotation. The burster 33 also includes a bursting blade 36 disposed between the rollers on one side of the imaginary straight line between the roller nips, and adapted to engage the release material surface 13 of the leading label 11 in a string 10 at the tie 12 so that bursting along the tie 12 takes place.

The stationary bursting blade 36 is also over a non-stick guide surface 37 which is also mounted between the rolls 19, 20 and 34, 35 and extend substantially along the imaginary straight line between the nips. The non-stick surface 37 engages the pressure-sensitive adhesive 14 face of the label string 10. It is preferred that the non-stick characteristics of the surface 37 be obtained by plasma coating. The lower low speed roller 19 and the lower high speed roller 34, which engage the adhesive surface 14, also are both preferably non-stick coated, so that they do not adhere to the adhesive 14. Also the distance between the roll pairs 19, 20 and 34, 35 are fixed to one label 11 length, with the tie 12 (or a series of ties) aligned with the bursting blade 36.

Conventional bursters (which are similar to the burster 33 only not utilizing the non-stick surface 37 and corresponding non-stick surfaces on the rollers 19, 34) typically operate at a differential speed ratio of 2:1 between the high speed and low speed rolls. The speed ratio according to the present invention is preferably between 3:1 and 2:1, including all ratios in between, i.e. the velocity $V_2$ (see FIG. 6) is 2–3 times the velocity $V_1$. Also, a sensor 38 (of any suitable conventional type, e.g., optical) is preferably provided downstream of the high speed rolls 34, 35 in the direction 18 to sense a leading label 11 after it has been burst, and to in turn move a surface into contact with the label and/or operate another label engaging element to engage the label and move it into contact with the surface. A second sensor (shown generally at 39 in FIG. 9) may also be provided to sense a moving surface to which the detached label 11 is to be applied. The sensors 38, 39 may also control the drive of the high speed rolls 34, 35 to stop the drive so that the leading label is essentially parked until acted upon by a label engaging element or a moving surface to which the label is applied.

A wide variety of label-engaging means may be provided downstream of the high speed rolls 34, 35 in the first direction 18 for engaging a label 11 as it moves through the nip of the high speed rolls 34, 35. Four different such label engaging means are illustrated in FIGS. 7 through 13. All of them may be integrated with the operation of the rollers 34, 35 by the sensor 38 and/or the sensor 39.

In the FIGS. 7 and 8 embodiment, the label-engaging means comprises a horizontally movable plunger 42 mounted for movement by a rod 43 in a direction 44 perpendicular to the direction 18. The plunger 42 engages the release material face 13 of the label 11 and moves the adhesive face 14 into contact with a surface 45 to which the labels can be applied. In FIG. 8 the surface 45 is shown as being one of the sides or top of a cardboard carton 46, which is mounted on a conveyor means 47 for movement in the direction 48. In the exemplary embodiment illustrated in FIGS. 7 and 8, the direction 48 is parallel to the direction 18, but that is not necessary. The conveying means 47 may be any conventional conveyor such as a conveyor belt, conveyor rollers, conveyor chains, conveyor platforms, etc.

In the embodiment of FIGS. 9 and 10 the label engaging means comprises a conveyor belt 50 mounted just downstream of the nip of the rolls 34, 35 in the direction 18 in position to cooperate with a bottle, can or like element 51 having a surface to which the label 11 is applied. The bottle 51 is moved by the conveyor 47 in the direction 52, the direction 52 in this case being perpendicular to the direction 18. A second conveyor belt assembly 53 is mounted on the opposite side of the conveyor 47 from the conveyor belt assembly 50 to rotate the bottle 51 as it moves in direction 52 and as the label 11 is being applied, as illustrated in FIG. 10. Conveyor belt assemblies 50, 53 can be driven or not driven, although it is preferred that the assembly 53 at least be driven.

FIG. 11 illustrates yet another form of label engaging means in this case in the form of a vacuum cylinder 55 which is mounted just downstream of the nip between the roller 34, 35 and is rotatable about an axis parallel to the rollers 35, 34 axes. The vacuum cylinder 55 engages the non-adhesive face 13 of the label 11 and moves the adhesive face 14 into contact with a surface 45 of a carton 46, or like object, being conveyed by the conveyor 47 in the direction 52, as seen in FIG. 12.

Figure 13:
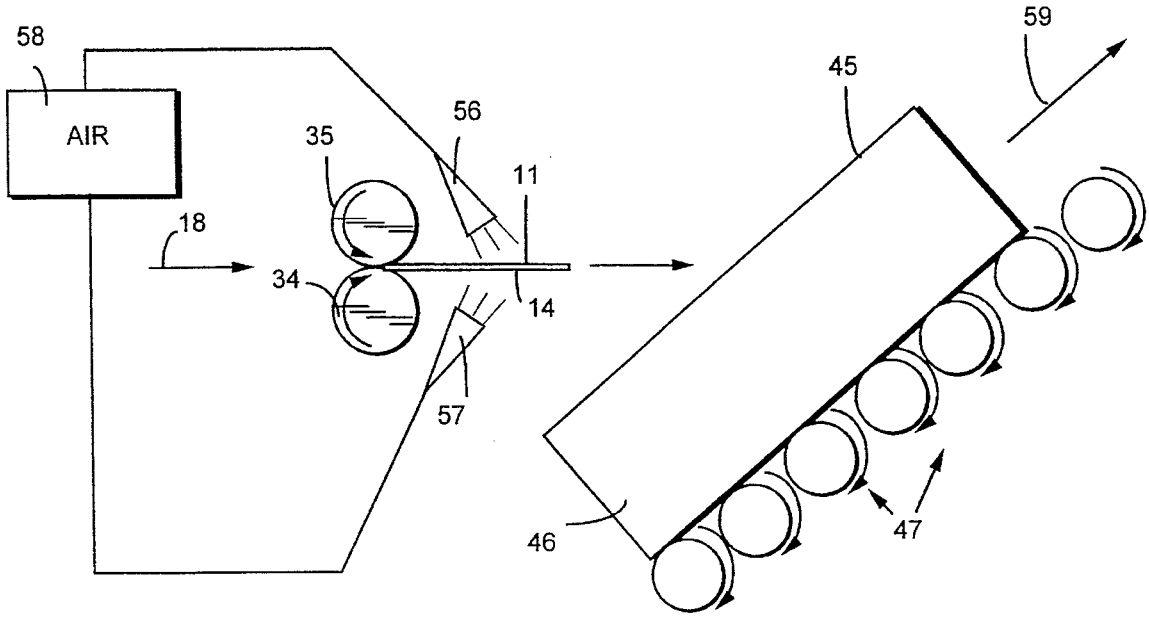
FIG. 13 is a view like that of FIG. 12 only showing gas blast nozzles for operatively engaging a detached label and moving it into contact with a surface being conveyed.

FIG. 13 illustrates another embodiment of the label engaging means in which just downstream of the nip between the rolls 34, 35 one more air/gas blast nozzles 56, 57 are located. The nozzles 56, 57 are connected up to a source of compressed gas (e.g., air, nitrogen, etc.) 58. Valves for automatically controlling the passage of compressed gas from the source 58 to the nozzles 56, 57 may be controlled by a sensor like sensor 38 in FIG. 6 (e.g., an optical sensor). The blasts of gas from the nozzles 56, 57 conveys the label 11 to the surface 45 of a carton 46 or like device being moved in direction 59 by the conveyor 47 (in this case the conveyor 47 being schematically illustrated as powered rollers with gripping surfaces). In this case the direction 59 may make an angle of about 30°–60° with respect to the direction 18.

The embodiments of FIGS. 7 through 13 illustrate various mechanisms for trapping, blowing or rolling a label detached by the detacher 33, onto a surface onto which the label is to be applied. However, other types of mechanisms also may be utilized for performing the same basic function.

It will thus be seen that according to the present invention, an advantageous label assembly consisting of a string of a plurality of non-quadrate linerless labels with ties between them, a method of acting upon individual non-quadrate linerless labels to separate them from the string and apply them to product surfaces, and a variety of different apparatus may be utilized which are highly advantageous.

While the invention has been herein shown and described in what is presently conceived to be the most practical and preferred embodiment, it will be apparent to those of ordinary skill in the art that many modifications may be made thereof within the scope of the invention, which scope is to be accorded the broadest interpretation of claims so as to encompass all equivalent methods, products and apparatus.

What is claimed is:

1. A method of acting on an individual non-quadrate linerless label in a string of in-line non-quadrate pressure sensitive adhesive linerless labels connected together, and to a surrounding matrix, by ties, using a burster having a first pair of low speed rolls, and a second pair of high speed rolls, with a stationary blade between the roller pairs, comprising the steps of:

(a) moving the string of non-quadrate pressure sensitive adhesive linerless labels, in a first direction, toward the first pair of rolls;

(b) separating the leading labels from the matrix;

(c) continuously automatically pulling the matrix in a second direction, distinct from the first direction, while physically engaging the label string so that the labels are not pulled with the matrix but instead are fed to the first pair of low speed rolls separated from the matrix;

(d) feeding the labels, one at a time, in sequence from the low speed rolls to the high speed rolls so that a tie connecting two consecutive labels of the string is positioned between the pairs of rolls;

(e) acting on a leading label of the string with the high speed rolls to cause the string to be tensioned and the tie between the roll pairs to engage the stationary blade and burst; and (f) discharging the leading label, burst from the string in step (e), from the high speed rolls.

2. A method as recited in claim 1 wherein the labels have a first face with adhesive release material and a second face with pressure sensitive adhesive; and wherein step (e) is practiced by bringing the first face into contact with the stationary blade.

3. A method as recited in claim 2 comprising the further step of, except during tensioning as recited in step (e), guiding the labels from the first to the second roll pairs by bringing the second face into contact with a non-stick guiding surface.

4. A method as recited in claim 2 comprising the further step (g), substantially immediately after step (f), of bringing the detached, leading linerless label second face into contact with a surface to which the adhesive adheres.

5. A method as recited in claim 4 wherein step (e) is practiced by pushing the first face in a third direction, substantially transverse to the first direction, until the second face engages the surface.

6. A method as recited in claim 4 wherein step (e) is practiced by engaging the first face with a rotatable element, and rotating the rotatable element to assist in moving the label second face into contact with the surface.

7. A method as recited in claim 6 wherein step (e) is further practiced by substantially simultaneously moving the surface into engagement with the second face.

8. A method as recited in claim 4 comprising the further step (h) of sensing the presence of the leading label being discharged during the practice of step (f), and moving the surface toward the label in response to step (h).

9. A method as recited in claim 1 wherein the labels have a first face with adhesive release material and a second face with pressure sensitive adhesive; and wherein step (c) is practiced by physically engaging the first face of the label string with a smooth, substantially stationary, surface.

10. A method as recited in claim 1 wherein steps (a) and (c) are practiced primarily solely by pulling the label string with the low speed rolls.

11. A method as recited in claim 8 wherein the labels are substantially circular, and the leading label is connected to the following label by a single tie having a width of about 0.018–0.030 inches; and wherein step (e) is practiced by moving the single tie into contact with the stationary blade.

12. A method as recited in claim 8 wherein steps (a), and (c)–(e) are practiced by providing a speed differential of between 3:1 to 2:1 between the high speed and low speed rolls.

13. A method as recited in claim 1 wherein the labels are substantially circular, and the leading label is connected to the following label by a single tie having a width of about 0.018–0.030 inches; and wherein step (e) is practiced by moving the single tie into contact with the stationary blade.

14. A method as recited in claim 1 wherein steps (a), and (c)–(e) are practiced by providing a speed differential of between 3:1 to 2:1 between the high speed and low speed rolls.

* * * * *